US006266023B1

(12) United States Patent
Nagy et al.

(10) Patent No.: US 6,266,023 B1
(45) **Date of Patent: *Jul. 24, 2001**

(54) AUTOMOTIVE RADIO FREQUENCY ANTENNA SYSTEM

(75) Inventors: Louis Leonard Nagy; Douglas Courtney Martin, both of Warren; Michael Jerome Lewis, Southfield, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/339,453

(22) Filed: Jun. 24, 1999

(51) Int. Cl.[7] ..... H01Q 1/32
(52) U.S. Cl. ..... 343/713; 343/711
(58) Field of Search ..... 343/713, 711, 343/712; H01Q 1/32

(56) References Cited

U.S. PATENT DOCUMENTS

| | | | | |
|---|---|---|---|---|
| 4,914,447 | * | 4/1990 | Ishii et al. | 343/713 |
| 5,017,933 | * | 5/1991 | Sakurai et al. | 343/704 |
| 5,083,135 | | 1/1992 | Nagy et al. | 343/713 |
| 5,229,780 | * | 7/1993 | Hirotsu et al. | 343/713 |
| 5,239,303 | * | 8/1993 | Hirotsu et al. | 343/713 |
| 5,334,989 | * | 8/1994 | Nagayama et al. | 343/713 |
| 5,528,314 | | 6/1996 | Nagy et al. | 348/713 |
| 5,557,289 | * | 9/1996 | Ohara | 343/713 |
| 5,629,711 | * | 5/1997 | Matsuoka et al. | 343/704 |
| 5,640,167 | * | 6/1997 | Hall | 343/713 |
| 5,663,737 | * | 9/1997 | Kakizawa | 343/713 |
| 5,714,959 | * | 2/1998 | Troy et al. | 343/713 |
| 5,739,794 | | 4/1998 | Nagy et al. | 343/713 |
| 5,936,585 | * | 8/1999 | Hall | 343/713 |
| 5,999,135 | * | 12/1999 | Nozaki et al. | 343/713 |
| 5,999,136 | * | 12/1999 | Winter et al. | 343/713 |
| 6,008,766 | * | 12/1999 | Maeda et al. | 343/713 |
| 6,031,500 | * | 2/2000 | Nagy et al. | 343/713 |

* cited by examiner

*Primary Examiner*—Don Wong
*Assistant Examiner*—Trinh Vo Dinh
(74) *Attorney, Agent, or Firm*—Jimmy L. Funke

(57) ABSTRACT

A window antenna is provided for receiving electromagnetic radio waves from a motor vehicle. The vehicle has a metallic structure that forms an aperture with a window glass disposed within. The window glass has an upper region and a substantially horizontal top edge that interfaces with the metallic structure. The antenna is formed from an electrically conducting material affixed to the window glass. The antenna includes a horizontally elongate principal element that is substantially parallel to and spaced from the upper edge portion of the window. The principal element electrically connects to a connecting element which extends downwardly therefrom. The connecting element electrically connects to an auxiliary element that is spaced below the principal element by an amount sufficient that no significant coupling is formed therewith.

15 Claims, 3 Drawing Sheets

AUTOMOTIVE RADIO FREQUENCY ANTENNA SYSTEM

TECHNICAL FIELD

This invention relates to radio-frequency antenna systems that affix to a vehicle window.

BACKGROUND OF THE INVENTION

With the increasing development of communications devices and the expanding variety of those devices, there has been an increased demand to locate associated antennas in areas that improve the performance of the communication devices. In motor vehicles, concerns with aesthetics and not obstructing the view of the vehicle occupants further limit the range of desirable locations for antennas. Typical communication devices that are now installed in many vehicles include AM/FM radios, cellular phones, and vehicle remote keyless entry systems. Also, vehicle remote start-up systems are projected to enter the market in the near future.

Generally, traditional remote keyless entry systems include an internal antenna to receive radio waves that direct the system to lock or unlock the vehicle. The keyless entry module is usually located under the dashboard within the passenger compartment or other locations within the vehicle. Typically, these systems have provided satisfactory performance, however reception of the vehicle lock/unlock signal is limited due to attenuation of the signal by the intervening vehicle structure. Additionally, intermittent reception of the lock/unlock signal occurs depending on the direction from which the signal is transmitted due to differences in the amount of vehicle structure that intervene between the signal source and the internal antenna. For example, the keyless entry system might be unresponsive to a signal transmitted from near the back quarterpanel, but be responsive to a signal transmitted from near the driver's side door. Intermittent or inconsistent operation is undesirable because of the possibility of customer dissatisfaction.

An alternative to mounting an antenna in the passenger compartment is to mount the antenna in the windshield. Traditionally, mast or whip antennas have been used to receive and transmit radio waves from a motor vehicle. Recently, thin film antennas that are affixed to a vehicle window have been developed (see U.S. Pat. Nos. 5,083,135, 5,528,314, and 5,739,794). The thin film antennas have eliminated the need for mast or whip antennas for VHF and UHF reception.

U.S. Pat. No. 5,083,135 issued Jan. 21, 1992, describes a transparent film antenna for a vehicle window in the shape of a "T" with a horizontally elongate principal element spaced from and parallel to the upper horizontal edge of the window and a vertically elongate impedance matching element extending down the window from the center of the principal element. A disadvantage associated with film antennas wherein the elements extend into the main viewing area of the windshield is the impact on vehicle appearance resulting when sunlight reflects off of the surface of the windshield. The sunlight tends to have a shimmering effect on the area of the windshield where the film antenna is embedded.

U.S. Pat. No. 5,528,314 issued Jun. 18, 1996 and U.S. Pat. No. 5,739,794 issued Apr. 14, 1998, provide improved film antennas (referred to as solar-ray antennas) that do not degrade the appearance of the vehicle. Both solar-ray antennas include a horizontally elongate principal element spaced from and parallel to the upper horizontal edge of the window. Each antenna includes an impedance matching element coupled to the principal element and extending outward so that it is spaced from the edge of the window aperture so as to form a slot transmission line. The impedance matching elements therefore enclose or occupy almost the entire windshield with the exception of a strip across the top in the area that is normally tinted.

A vehicle that employs a solar-ray antenna for AM/FM reception precludes using a conventional film antenna for a vehicle keyless entry system because of physical interference. The solar-ray antenna encloses virtually the entire windshield except for the tinted area at the top. A vehicle keyless entry system that employed a conventional film antenna located in the tinted region of the windshield would require a vertical impedance matching element that would extend into the impedance matching element of the solar-ray antenna. If the solar-ray impedance matching element is shifted to a lower position on the windshield so as to avoid physical interference with the keyless entry system antenna, the appearance of the vehicle will be degraded due to the shimmering effect of the windshield area with the film antenna contrasting with the remainder of the windshield. Accordingly, what is desired is a film antenna that can be located entirely within the tinted area of a windshield.

SUMMARY OF THE INVENTION

A vehicle window antenna is provided for receiving electromagnetic radio waves. The vehicle has a metallic structure that forms an aperture with a window glass disposed within. The window glass has an upper region and a substantially horizontal top edge that interfaces with the metallic structure. The antenna is formed from an electrically conducting material affixed to the window glass. The antenna includes a horizontally elongate principal element that is substantially parallel to and spaced from the upper edge portion of the window. The principal element includes an upper edge and a lower edge. The lower edge electrically connects to a connecting element which extends downwardly. The lower portion of the connecting element electrically connects to an auxiliary element that has an upper edge spaced below the principal element by an amount sufficient that no significant coupling is formed therewith.

BRIEF DESCRIPTION OF THE DRAWINGS

The present invention will now be described, by way of example, with reference to the accompanying drawings, in which.

DESCRIPTION OF THE PREFERRED EMBODIMENT

The present embodiment of the invention is configured as a small high frequency antenna for a vehicle remote keyless entry system that operates at 315 MHz with a wavelength of 952 mm. However, the principles of the invention extend to antennas designed for other vehicle systems such as electronic toll, cellular, GPS, GMS, and PCS. The antenna is preferrably located in the upper tinted region of the vehicle windshield, although other locations on a vehicle window are within the scope of the invention. The vehicle in the preferred embodiment includes an AM/FM reception solar-ray antenna in addition to one or more high frequency antennas. The solar-ray antenna extends over a substantial portion of the main viewing area of the vehicle windshield limiting the potential locations for high frequency antennas.

Figure 1:
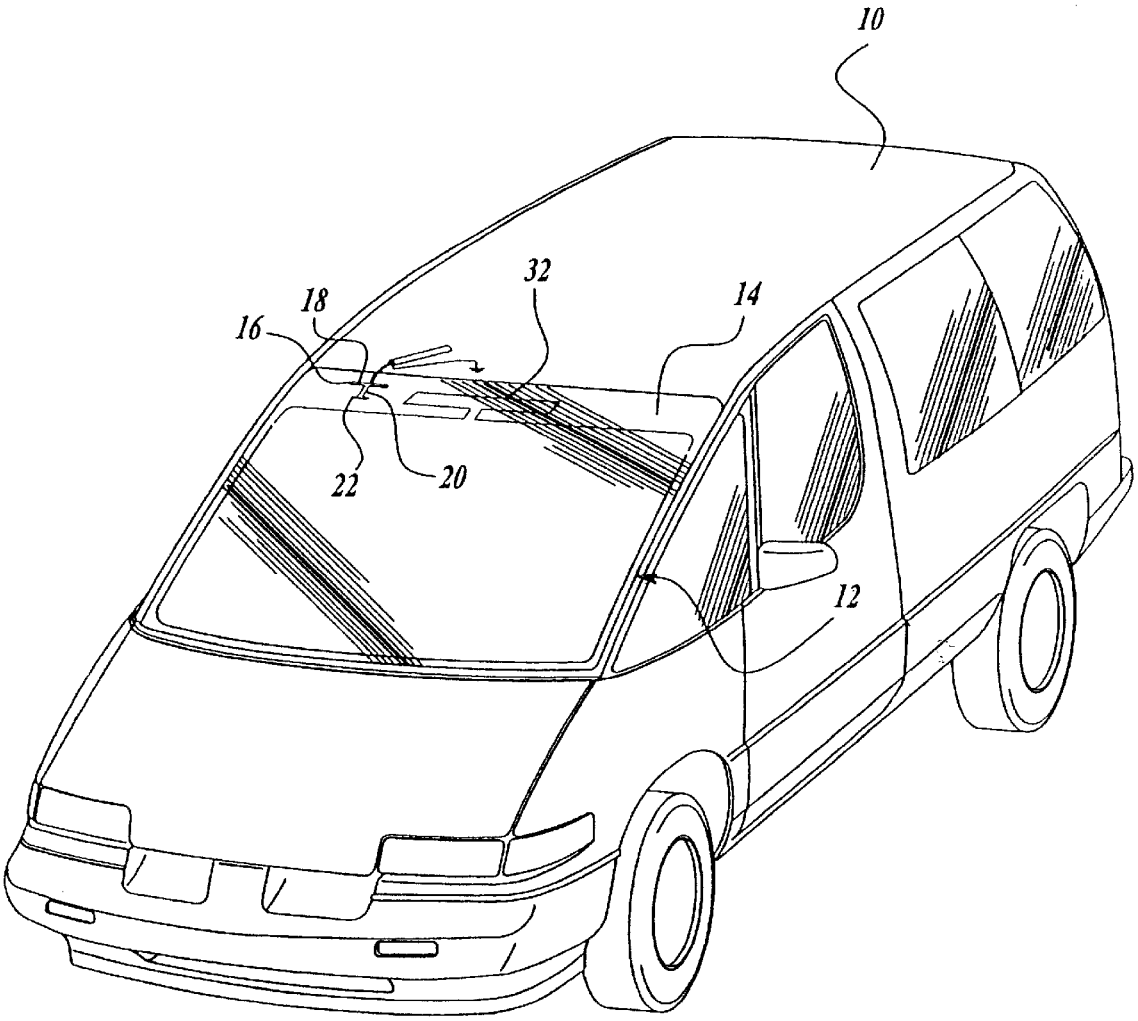
FIG. 1 shows a vehicle having a window provided with an antenna according to the invention.

Referring to FIG. 1, a vehicle body 10 including a window antenna 16 for a keyless entry system is illustrated. The vehicle body 10 is made of an electrically conducting metal such as steel or aluminum and having a window defined by a body window edge 11. A window glass 12 overlaps the body window edge 11 around its periphery to provide a windshield for the vehicle body 10. The windshield 12 is preferably a standard laminated automobile windshield formed of two layers of glass with an interposing thermoplastic or polyvinyl butyral layer.

Figure 2:
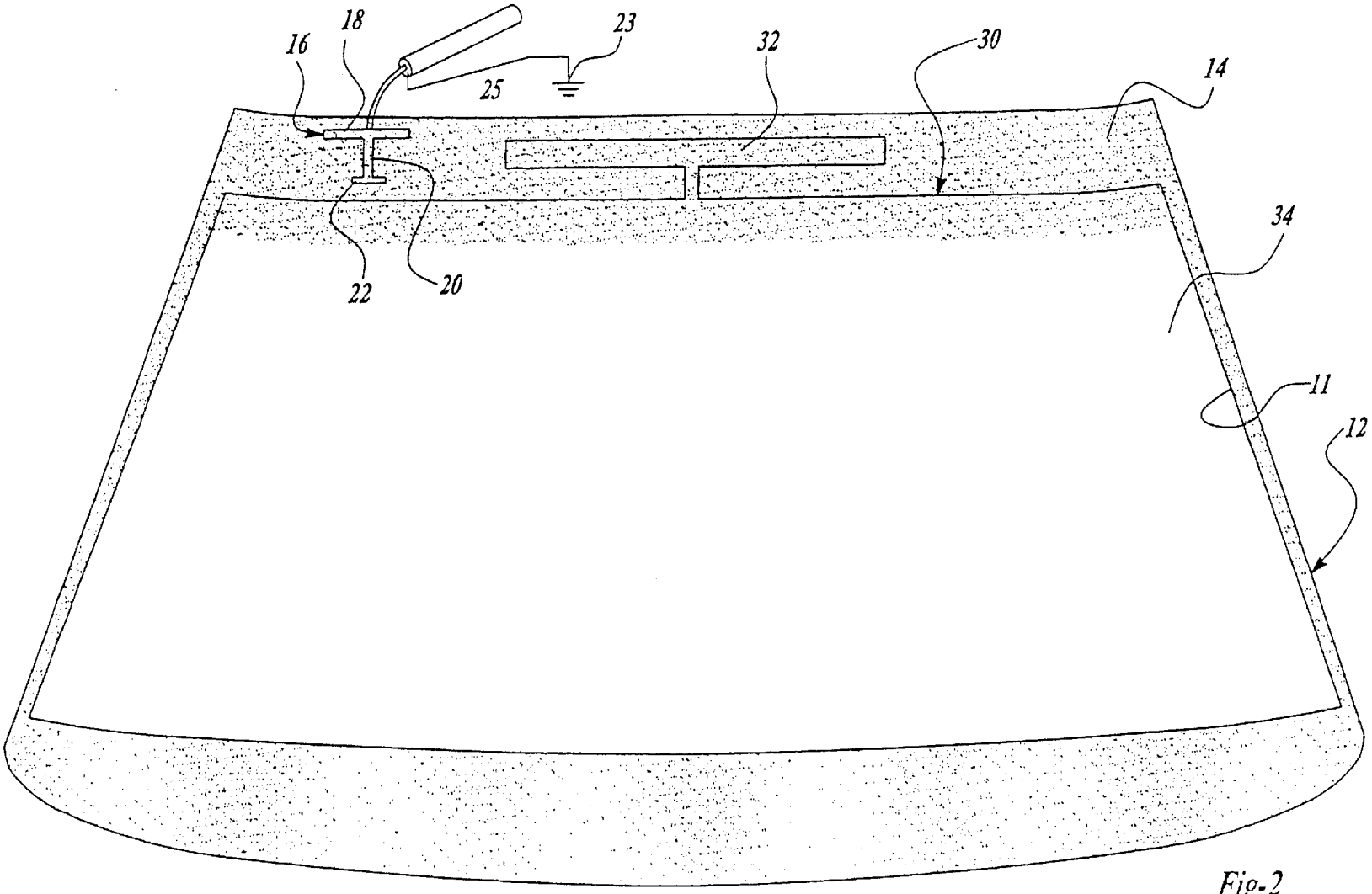
FIG. 2 shows a detailed view of a vehicle windshield provided with an antenna according to the invention.

With reference to FIG. 2, a detailed section of the windshield 12 is illustrated. The windshield 12 may optionally be provided with a longitudinally extending the tinted region 14 across the top. This tinted region 14, commonly used in windshields for light and glare reduction, may be advantageously utilized in this invention to render the antenna less visible. Representing one embodiment of the present invention, the window antenna 16 is shown disposed in the tinted region 14 of the windshield 12. For reception of AM/FM signals, a solar-ray antenna 30 is mounted in the main viewing area of the windshield 12. Before describing the window antenna 16, first the solar-ray antenna 30 will be briefly described.

The solar-ray antenna 30, configured as described in U.S. Pat. No. 5,528,314, is shown disposed substantially in the main viewing area of the windshield 12. The solar-ray antenna 30 is formed from an electrically conducting material affixed to the windshield 12. The solar-ray antenna 30 is a planar antenna of substantially constant thickness, therefore, its reception and radiating characteristics are greatly affected by its planar shape. The antenna 30 may be described as comprising two basic elements: a principal element 32 and an impedance matching element 34. The principal element 32 is centrally located within the tinted region 14 of the windshield 12. The principal element 32 is essentially rectangular in shape and substantially parallel to and spaced from the horizontal upper portion of the body window edge 11. The impedance matching element 34 substantially covers all of the windshield 12 below the tinted region 14 and thus most or all of the main viewing area of the windshield 12.

The window antenna 16 for the keyless entry system is formed from an electrically conducting material affixed to the windshield 12. Suitable conducting materials include non-transparent films and frit material such as silver and glass. Alternatively, the antenna 16 may be made of single or multi-layer transparent conductive films such as provided by indium-tin-oxide or layers of silver and titanium dioxide, which are essentially transparent to visible light and electrically conducting, preferably having a sheet resistance of 4 ohms per square or less. The scope of the invention is not limited to the aforementioned conducting materials, any film of material having suitable transparency and conductivity may used to form the antenna 16. The basic requirement for the conducting material is to provide sufficient conductivity for the electric currents that run along the edges of the elements. For a given sheet resistance, this conductivity will vary with the width of the strip of material that conducts current. Visually transparent materials generally have larger sheet resistances and must therefore be made wider, but their transparency allows the wider elements to be placed on a window without compromising window viewing area constraints. The materials with lower sheet resistance, such as the frit material mentioned above, are generally non-transparent to visible light; and window antenna elements made therefrom must therefore be made narrower or located at the edge of the windshield 12 so as not to affect visibility through the window.

Figure 3:
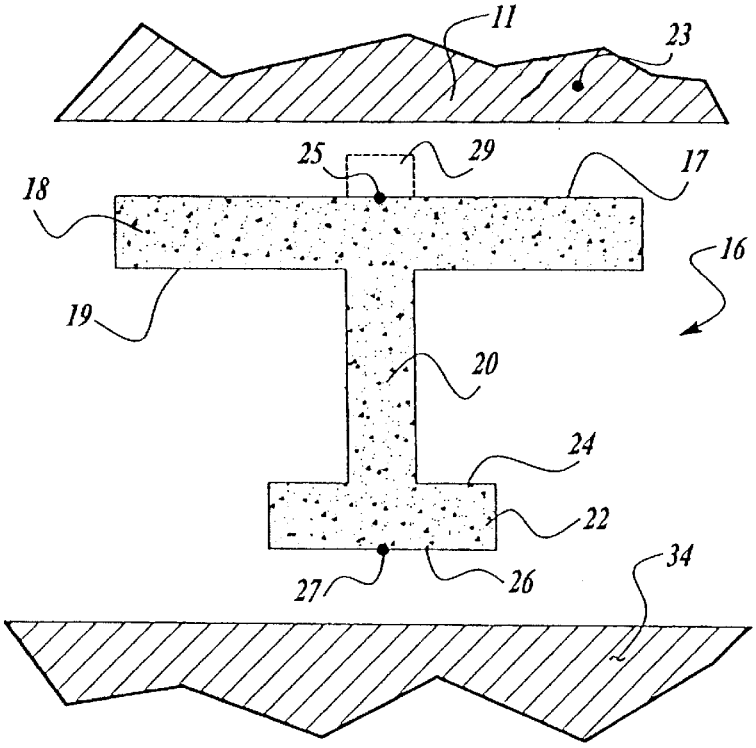
FIG. 3 illustrates a presently preferred embodiment of the invention.

Referring to FIG. 3, a magnified view of the antenna 16 is provided. The antenna 16 is a planar antenna, therefore, its reception and radiating characteristics are greatly affected by its planar shape. The antenna 16 may be described as comprising three basic elements: a principal element 18, a connecting element 20, and an auxiliary element 22. The connecting element 20 and auxiliary element 22 combine to provide the impedance matching element function of prior art antennas. In conventional window antennas, the impedance matching element is a vertically elongate member that attaches to the central portion of the lower edge of the principal element. An antenna employing such a configuration in the present application would extend downward into the main viewing area of the windshield and physically interfere with the solar-ray antenna impedance matching element. In the presently preferred embodiment the combination of the connecting element 20 and auxiliary element 22 provides an area efficient replacement for the prior art impedance matching element. By maintaining approximately the same circumference for the combination as would be required for the prior art impedance matching element, and extending a the auxiliary element 22 sidewardly instead of downwardly, approximately the same antenna impedance is attained while requiring less vertical length for the antenna 16. Similar to a prior art impedance matching element, the connecting element 20 combined with the auxiliary element 22 behaves as a short inverted monopole with respect to the vehicle body 10. The impedance of the antenna 16 is tuned by adjusting the current path length (outer circumference of the elements 20 and 22) of the combination of the connecting element 20 and the auxiliary element 22. The combination has an associated impedance which varies primarily as a function of the current path length. By attaching the connecting element 20 and auxiliary element 22 to the principal element 18, their respective impedances essentially combine in parallel and appear as the total impedance for the antenna 16 between the feed point and ground point.

The principal element 18 is similar in outer shape and orientation to the principal element of the referenced U.S. Pat. No. 5,083,135. The principal element 18 is located substantially parallel to and spaced from the upper horizontal portion of the body window ledge 11. The principal element 18 is essentially rectangular, although its horizontal edges may follow any slight curvature of the upper horizontal portion of the body window ledge 11 and its corners may be rounded for a more pleasing appearance. Additionally, since most of the electrical currents flowing in the principal element 18 exist near its outer edges, it is not necessary for the principal element 18 to be continuous over the entire area within its outer dimensions. The principal element 18 is a tuned element having an effective horizontal length of an odd integer of one-quarter of the wavelength to which it is tuned.

The principal element 18 exhibits a zero reactive impedance at the tuned wavelength. In the presently preferred embodiment, the antenna 16 is designed for reception of a 315 MHz signal that controls a remote keyless entry system for a vehicle. The principal element 18 is tuned to a wavelength, 952 mm, corresponding to the operating frequency and thus has an effective horizontal length of about 238 mm. As with the antenna of U.S. Pat. No. 5,083,135, it has been found that the physical length of the principal element 18 at resonance is somewhat shorter than a measured one-quarter of the actual signal wavelength. The referenced patent provides a detailed description of the coupling effects that cause the reduced length of principal element 18. In the presently preferred embodiment, the principal element 18 has been found to work well with an actual horizontal length of 152 mm and a vertical width of 12.7 mm. The principal element 18 is ideally spaced below the upper horizontal portion of the body window edge 11 by a distance which provides maximum signal gain, but this distance may be compromised to obtain other advantages for a particular vehicle design as will be described below. In the presently preferred embodiment, the principal element 18 is preferably spaced 6.4 mm from the upper horizontal portion of the body window edge 11, although a spacing in the range 4.76 mm to 15.9 mm is also appropriate.

The connecting element 20 is preferably formed from an elongated strip or ribbon being substantially perpendicular to the principal element 18. The connecting element 20 is electrically connected to the center portion of the lower edge of principal element 18, extending therefrom downwardly. Although in the presently preferred embodiment the connecting element 20 electrically connects to the center portion of the principal element 18, it is within the scope of the invention to connect the connecting element along other portions of the lower edge of the principal element 18. The length of the connecting element 20 is selected so as to minimize transmission coupling effects between the principal element 18 and auxiliary element 22. In the presently preferred embodiment, a length of preferably 50.8 mm is employed. Since most of the electrical currents flowing in the connecting element 20 exist near its outer edges, it is not necessary for the connecting element 20 to be continuous over the entire area within its outer dimensions. To simplify manufacture, the connecting element 20 is preferably formed of the same material and the same process as the principal element 18.

The auxiliary element 22 is preferably comprised of a strip or ribbon extending from the connecting element 20 and made from the same material in the same process. The auxiliary element 22 is substantially horizontally elongate having an upper portion 24 connected to the lower portion of connecting element 20, extending therefrom substantially equally towards each side. Although in the presently preferred embodiment the center of the upper portion of the auxiliary element 22 electrically connects to the lower portion of the connecting element 20, it is within the scope of the invention to connect to other places along the upper edge of the auxiliary element 22 to the lower portion of the connecting element 20. The angle at which the auxiliary element 22 connects to the connecting element 20 is selected so as to minimize transmission coupling effects between the principal element 18 and auxiliary element 22. The lower edge of the auxiliary element 22 is spaced a sufficient distance from solar-ray antenna impedance matching element 34 so as to minimize transmission coupling effects between the auxiliary element 22 and the impedance matching element 34. In the presently preferred embodiment, a spacing of preferably 19.0 mm is maintained, although a spacing approaching 12.8 mm is allowable. Since most of the electrical currents flowing in the auxiliary element 22 exist near its outer edges, it is not necessary for the auxiliary element 22 to be continuous over the entire area within its outer dimensions. To simplify manufacture, the auxiliary element 22 is preferably formed of the same material and the same process as the connecting element 20.

The window antenna 16 is preferably fed at feed point 25 located along the upper edge of the principal element 18; preferrably approximately centered along the upper edge of the principal element 18. The window antenna 16 may also be fed by a feed apparatus 29 extending upward from the upper edge. The feed apparatus 29 encompasses any of the feed arrangements described in U.S. Pat. No. 5,528,314 and U.S. Pat. No. 5,648,785 issued on Jul. 15, 1997, both of which are incorporated by reference with regard to such feed arrangements.

The connecting element 20 and auxiliary element 22 in combination behave as a short inverted vertical monopole with respect to the metallic structure of the vehicle 10. The combination has an associated impedance which varies primarily as a function of the current path length. By attaching the connecting element 20 and auxiliary element 22 to the principal element 18, the respective impedance of those elements essentially combine in parallel and appear as the total impedance for the antenna 16 between the feed point 25 and ground point 23. As a result, the impedance of the antenna 16 can be tuned by adjusting the current path length of the connecting element 20 and auxiliary element 22. This can be particularly useful in improving the impedance match between a particular coaxial cable and film antenna 16 to maximize antenna gain.

To maintain an aesthetically pleasing appearance, the upper edge of the solar-ray antenna impedance matching element 34 is preferably located within the tinted region 14 of the windshield 12. The location of the impedance matching element upper edge constrains the location of the window antenna 16 to a region spaced sufficiently above the upper edge so as to minimize transmission line coupling between the window antenna 16 and the impedance matching element 34. The overall height of the window antenna 16 is limited to the distance between the impedance matching element 34 and the window edge 11. Generally, maximum antenna performance of the window antenna 16 is obtained when the principal element 18 is spaced a certain distance below the window edge 11 and the auxiliary element 22 is spaced a certain minimum distance away from the solar-ray impedance matching element 34. However, it might not be possible to space the antenna 16 the optimum distance from the window edge 11 and impedance matching element 34 due to limitations on the vertical extent of the tinted region 14. Restrictions imposed by design or governmental requirements on the extent of the tinted region 14 may limit the overall height of the antenna 16. Therefore, the optimum spacings and element lengths of the window antenna 16 may have to be compromised, with a resulting decrease in antenna gain.

Figure 4:
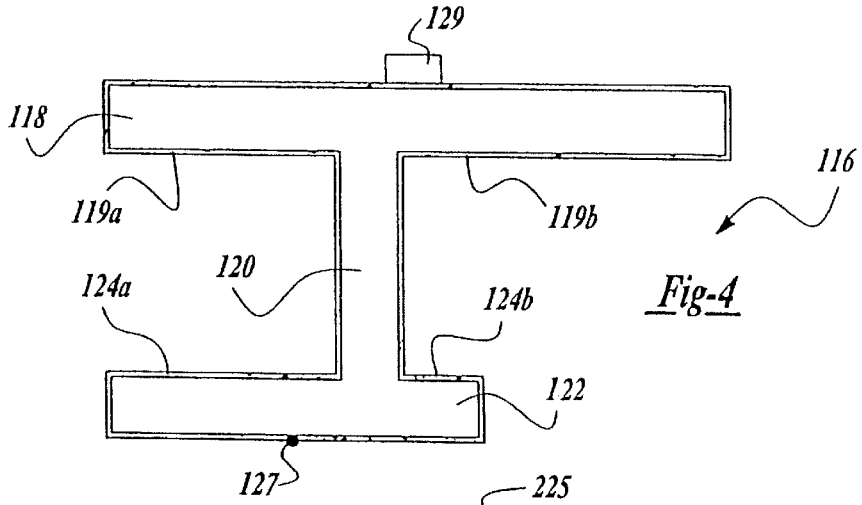
FIG. 4 illustrates an embodiment of the invention formed with ribbon conductors.

Referring to FIG. 4, another antenna 116 configured in accordance with the principles of the invention is illustrated. Antenna 116 is similar to antenna 16 in function with corresponding elements numbered in the range 100-199, except that antenna 116 is non-symmetrical and the elements are constructed of electrically conducting ribbon material approximately 2 mm in width affixed to the windshield 12. The principal element 118 is substantially parallel to and spaced from the upper horizontal portion of the window edge 123. The length of the principal element lower edge 119*a* is substantially shorter than the principal element lower edge 119*b*. The connecting element 120 electrically connects to the lower edges 119*a* and 119*b* of the principal element 118 and extends downwardly therefrom. The lower portion of the connecting element 120 connects to the upper edges 124*a* and 124*b* of the auxiliary element 122. The lengths of the upper edges 124*a* and 124*b* are set so that the upper edge 124*a* in combination with the principal element lower edge 119*a* is approximately equivalent in length to the combination of the upper edge 124*b* and the principal element lower edge 119*b*. The antenna 116 is fed by a feed apparatus 129 located at approximately the center of the upper edge of the principal element 118. The feed apparatus 129 is similar to previously disclosed feed apparatus 29. The null point 127 of antenna 116 is preferably located at the center of the lower edge of the auxiliary element 122, although other locations along the smooth portion of the auxiliary element lower edge are within the scope of the invention.

Figure 5:
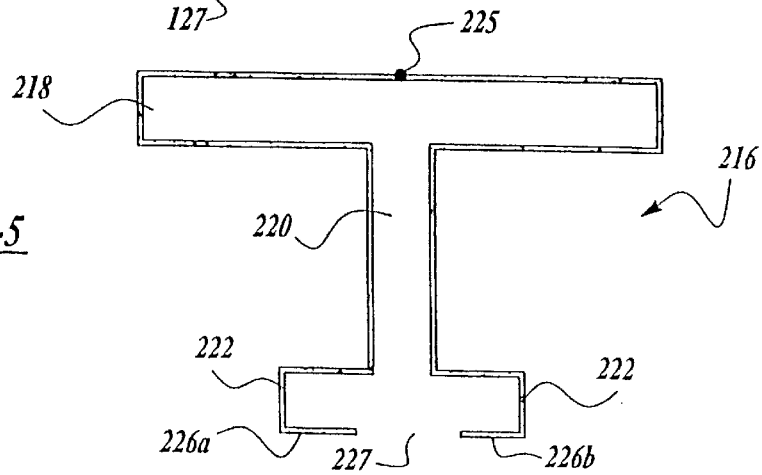
FIG. 5 illustrates an embodiment of the invention formed with ribbon conductors that terminate in an open circuit.

Referring to FIG. 5, another antenna 216 configured in accordance with the principles of the invention is illustrated. Antenna 216 is similar to antenna 16 in function with corresponding elements numbered in the range 200–299. Antenna 216 differs from antenna 16 in that the elements of antenna 216 are constructed of electrically conducting ribbon material approximately 2 mm in width affixed to the windshield 12 and the ribbon material is electrically discontinuous along the lower edge of the auxiliary element 222 at the null point 227. Current paths for the antenna 216 extend outward from the feed point 225 along the upper edge of the principal element 218. The current paths continue along the ribbon conductor on either side of the connecting element 220 through to the auxiliary element lower edges 226*a* and 226*b* and terminate at the null point 227. Current that flows from the feed point 225 through the principal element 218 and connecting element 220 flows through the respective lower edges 226*a* and 226*b* of the auxiliary element 222 and reflect back upon themselves at the null point 227.

The present invention recognizes that the reflected impedance of an antenna impedance matching element is related to the current path length of that element. A space efficient impedance matching element can be constructed by extending sideways portions from a portion of the element while effectively maintaining similar current path lengths. Physical symmetry of the current paths is not required, however the null point of the current paths is preferably located on a flat edge of the auxiliary element to ensure a consistent antenna impedance with slight variations in path lengths caused by manufacturing tolerances. It has been found that a window antenna constructed in this manner for high frequency signals can be restricted to the upper tinted region of a vehicle window and still provide acceptable antenna performance. Because the window antenna is configured within the tinted region of a vehicle window, a solar-ray antenna for AM/FM reception can be disposed within the main viewing area of the window.

It should be understood that while this invention has been described in connection with particular examples thereof, no limitation is intended thereby since obvious modifications will become apparent to those skilled in the art after having the benefit of studying the foregoing specification, drawings and following claims.

What is claimed is:

1. An antenna for receiving and transmitting electromagnetic radio waves from a motor vehicle, the vehicle having a metallic structure forming an aperture with a window glass disposed therein, the window glass having an upper region and an edge interfacing with the metallic structure, the antenna formed of an electrically conducting material affixed to the window glass, said antenna comprising:

a horizontally elongate principal element being substantially parallel to and spaced from the top edge of the window glass;

a connecting element electrically connected to the principal element and extending downwardly therefrom, the connecting element having a lower portion; and an auxiliary element electrically connected to the connecting element and extending sidewardly therefrom, the auxiliary element being spaced below the principal element so that no significant slot transmission line is formed therewith, wherein the principal element has a length at least three times greater than a length of the auxiliary element.

2. The antenna of claim 1 wherein the connecting element is approximately centrally connected to the auxiliary element.

3. The antenna of claim 1 wherein the connecting element is approximately centrally connected to the principal element.

4. The antenna of claim 1 wherein the auxiliary element is substantially parallel to the principal element.

5. The antenna of claim 1 wherein the electrically conducting material comprises a thin film of electrically conducting material.

6. The antenna of claim 1 wherein the electrically conducting material comprises a ribbon of electrically conducting material.

7. The antenna of claim 6 wherein the ribbon of electrically conducting material is about 2 mm wide.

8. The antenna of claim 6 wherein the electrically conducting ribbon forms an enclosed area.

9. The antenna of claim 6 wherein the auxiliary element includes a first section extending sideways from the connecting element toward one side of the window, and a second section extending sideways from the connecting element toward the other side of the window;

the first and second sections having downwardly extending portions and inwardly extending portions that remain sufficiently spaced from each other so that no significant slot transmission line is formed therewith.

10. The antenna of claim 1 wherein the principal element has an effective horizontal length of an odd multiple of one quarter of a predetermined wavelength.

11. The antenna of claim 1 wherein the principal element is spaced a predetermined distance from the edge of the window glass so as to maximise the antenna gain.

12. The antenna of claim 1 wherein the window glass is provided with a tinted region and the antenna is disposed within the tinted region.

13. An RF antenna formed of an electrically conducting material for receiving electromagnetic radio waves impinging on a motor vehicle, the vehicle having a structure forming an aperture with a window glass disposed therein, the window glass having substantially horizontal top and bottom edges interfacing with the vehicle structure and an upper region that includes a tinted region, the antenna being disposed within the tinted region, comprising:

a horizontally elongate principal element being substantially parallel to and spaced a predetermined distance from the top edge of the window glass, said principal element having an effective horizontal length of an odd multiple of one quarter of a predetermined wavelength;

a connecting element approximately centrally connected to the principal element and extending downwardly therefrom; and an auxiliary element approximately centrally connected to the connecting element, the auxiliary element being substantially parallel to and spaced below the principal element so that no significant slot transmission line is formed therewith, wherein the principal element has a length at least three times greater than a length of the auxiliary element.

14. An antenna for receiving and transmitting electromagnetic radio waves from a motor vehicle, the vehicle having a metallic structure forming an aperture with a window glass disposed therein, the window glass having an upper region and an edge interfacing with the metallic structure, the antenna formed of an electrically conducting material affixed to the window glass, said antenna comprising:

a horizontally elongate principal element being substantially parallel to and spaced from the top edge of the window glass;

a connecting element approximately centrally connected to the principal element at the lower portion and extending downwardly therefrom, the connecting element having a lower portion; and an auxiliary element approximately centrally connected to the connecting element and extending substantially perpendicular therefrom, the auxiliary element being spaced below the principal element so that no significant slot transmission line is formed therewith, wherein the principal element has a length at least three times greater than a length of the auxiliary element.

15. The antenna of claim 14 wherein the principal element has an effective horizontal length of an odd multiple of one quarter of a predetermined wavelength.

* * * * *